US006953367B2

(12) United States Patent
Ji et al.

(10) Patent No.: US 6,953,367 B2
(45) Date of Patent: Oct. 11, 2005

(54) ELECTRICAL CONNECTOR

(75) Inventors: Renhua Ji, Kunsan (CN); Yisheng Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/894,734

(22) Filed: Jul. 19, 2004

(65) Prior Publication Data

US 2005/0014418 A1 Jan. 20, 2005

(30) Foreign Application Priority Data

Jul. 18, 2003 (TW) ..... 92213187 U

(51) Int. Cl.[7] ..... H01R 24/00

(52) U.S. Cl. ..... 439/660; 439/607; 439/637; 439/181

(58) Field of Search ..... 49/660, 607, 181, 49/637

(56) References Cited

U.S. PATENT DOCUMENTS 5,066,240 A 11/1991 Verdun
5,199,897 A 4/1993 Hashiguchi
6,280,209 B1 * 8/2001 Bassler et al. ..... 439/101
6,340,315 B1 * 1/2002 Chang ..... 439/660
6,575,774 B2 * 6/2003 Ling et al. ..... 439/108
6,652,325 B2 * 11/2003 Tharp et al. ..... 439/660

* cited by examiner

*Primary Examiner*—Truc Nguyen
(74) *Attorney, Agent, or Firm*—Wei Te Chung

(57) ABSTRACT

An electrical connector (1) includes a housing (2), a number of contacts (3) received in the housing, and a shell (4) retained to the housing. The housing includes a main body (21), a first and a second tongues (22, 24) extending forwardly from the main body, and a mounting portion (23) extending rearwardly form the main body. The first and the second tongues define a number of passageways extending rearwardly throughout the main body. The mounting portion has a first and a second faces (2311,2312) on a first side (231), a third and a fourth faces (2321, 2322) on a second side (232), and a number of channels on the first, the second, the third and the fourth faces and communicating with the passageways. The second and the fourth faces are behind and offset from the first face and the third faces respectively.

17 Claims, 8 Drawing Sheets

ELECTRICAL CONNECTOR

BACKGROUND OF THE INVENTION

1. Field of the Invention

The present invention generally relates to an electrical connector, and particularly to an electrical connector adapted for the miniaturization trend of electronic field.

2. Description of Related Art

A micro coaxial cable assembly (MCCA) is usually used to connect a liquid crystal display (LCD) with a mother board of a notebook computer for providing video signal transmission therebetween. In some applications, the video signal needs to be transmitted from the mother board to a peripheral display device for obtaining a good visual effect. The video signal transmission between the mother board and the peripheral display device is generally carried out by a cable connector assembly having two DVI plug connectors connected by a cable and mating with two corresponding DVI receptacle connectors mounted on the mother board and the peripheral display device, respectively. Referring to FIG. 8, a conventional DVI plug connector 10 comprises an insulative housing 101, a metallic shell 102 assembled to a front end of the insulative housing 101 and defining a mating port 1021, and a plurality of contacts 103 received in the insulative housing 101 and having contact portions 1031 extending into the mating port 1021 for electrically connecting with a mating connector.

Due to an arrangement of the contacts, the conventional DVI plug and receptacle connectors are unadapted for the miniaturization trend of the notebook. A solution to the above problem is arranging contacts on plural tongues of an insulative housing of a connector to increase a density of contacts, such as an electrical connector disclosed in U.S. Pat. No. 5,066,240 (the '240 patent). However, tail portions of contacts received in the electrical connector of the '240 patent are arranged into plural rows and are suspended. It is labourious to solder the tail portions of the contacts with wires of a cable. Furthermore, after the tail portions have been soldered with the wires of the cable, short circuits between the tail portions or the wires occur easily.

Hence, an electrical connector having an improved structure is desired.

SUMMARY OF THE INVENTION

An object of the present invention is to provide an electrical connector which can simplify soldering between tail portions of contacts thereof and wires of a cable.

Another object of the present invention is to provide an electrical connector which can prevent short circuits between tail portions of contacts thereof.

To achieve the above objects, an electrical connector in accordance with the present invention comprises an insulative housing, a plurality of contacts received in the insulative housing, and a shell retained to the insulative housing. The insulative housing includes a main body, a first and a second tongues extending forwardly from the main body, and a mounting portion extending rearwardly form the main body. The first and the second tongues define a plurality of passageways extending rearwardly throughout the main body. The mounting portion has a first and a second faces on a first side, a third and a fourth faces on a second side opposite to the first side, and a plurality of channels on the first, the second, the third and the fourth faces and communicating with the passageways. The second and the fourth faces are behind and offset from the first face and the third faces respectively.

Other objects, advantages and novel features of the invention will become more apparent from the following detailed description when taken in conjunction with the accompanying drawings.

DETAILED DESCRIPTION OF THE INVENTION

Figure 1:
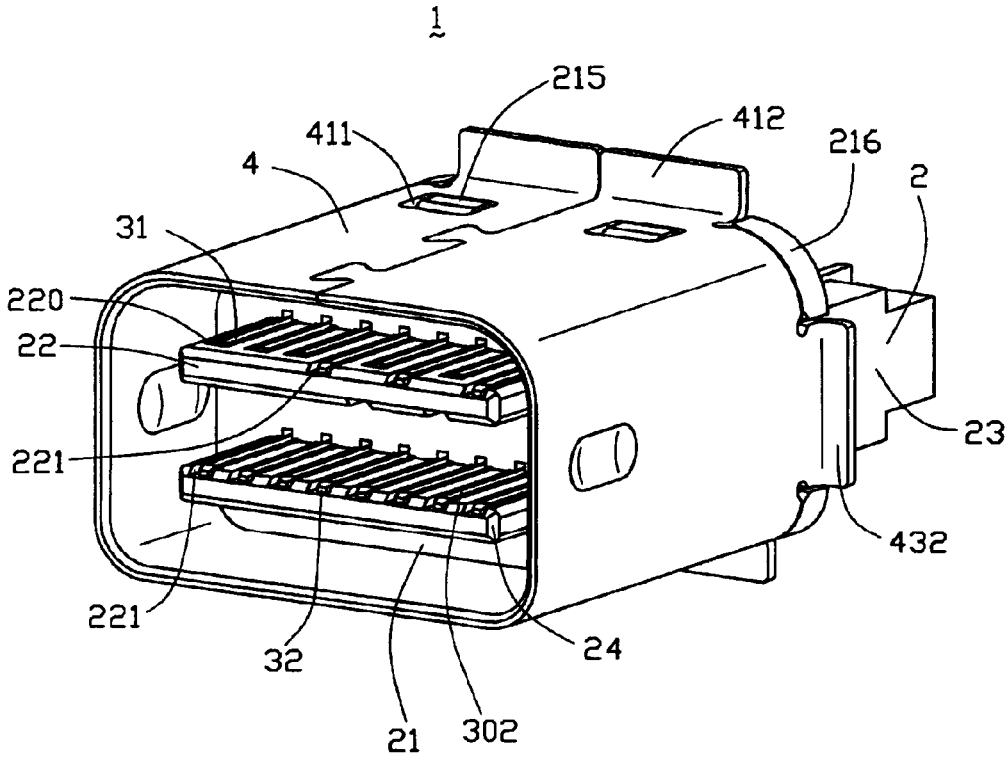
FIG. 1 is a front, top and right perspective view of an electrical connector in accordance with the present invention.
Figure 3:
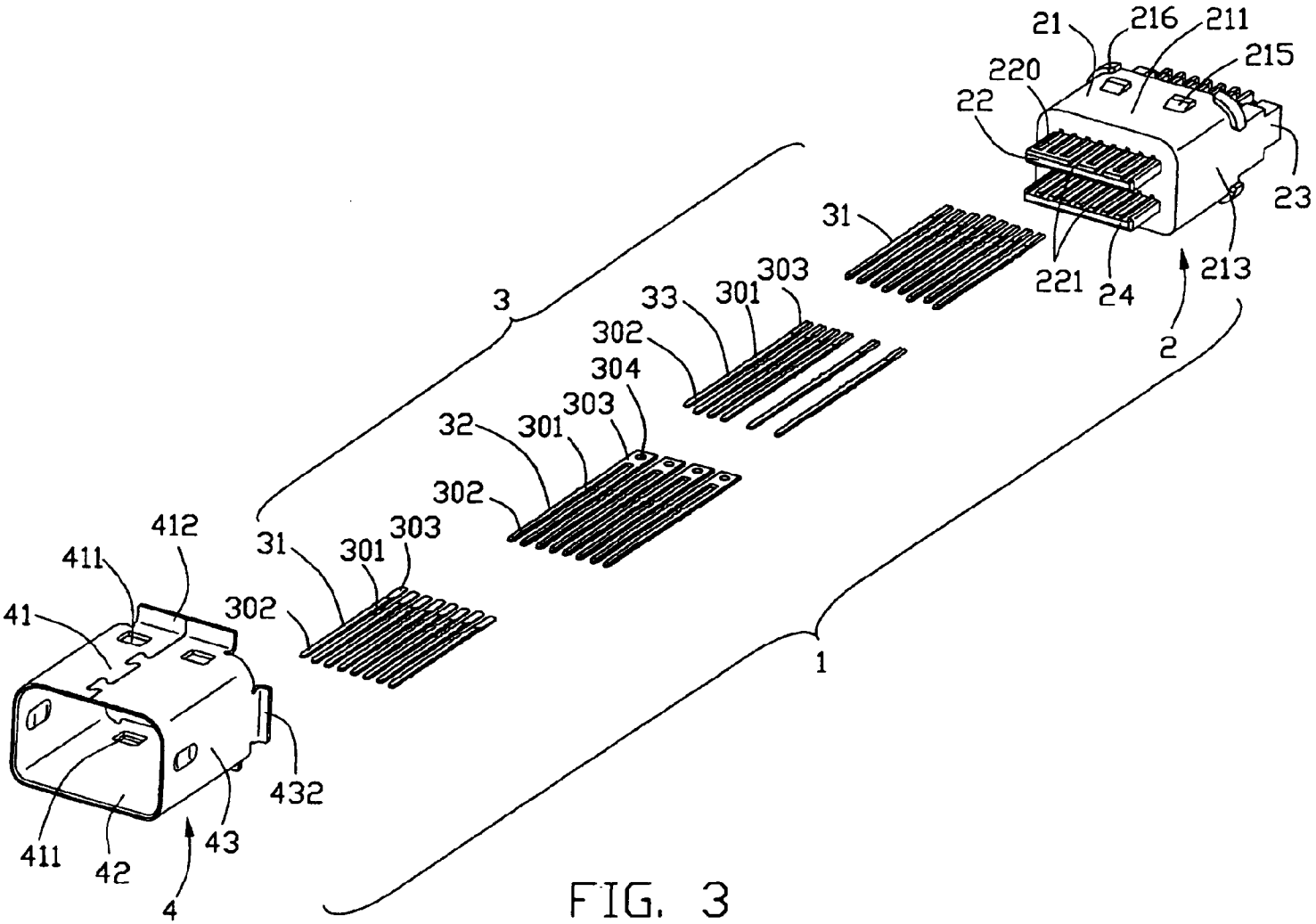
FIG. 3 is an exploded perspective view of the electrical connector of FIG. 1.
Figure 6:
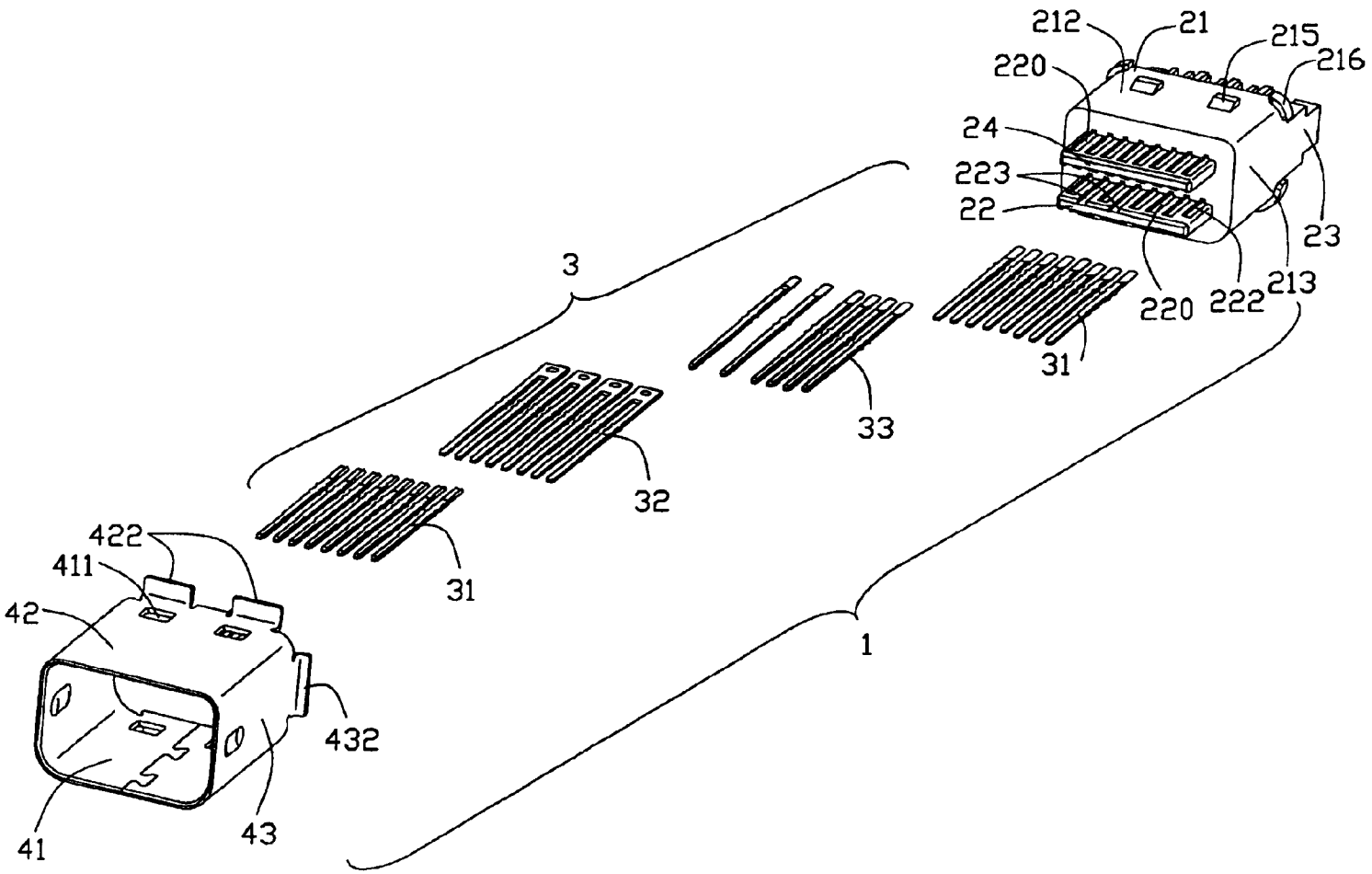
FIG. 6 is an exploded perspective view of the electrical connector of FIG. 4.

Referring to FIGS. 1, 3 and 6, an electrical connector 1 in accordance with the present invention comprises an insulative housing 2, a plurality of contacts 3 and a shell 4.

The insulative housing 2 comprises a main body 21, a first and a second tongues 22, 24 extending forwardly from the main body 21, and a mounting portion 23 extending rearwardly from the main body 21. The main body 21 has an upper face 211, a lower face 212 opposite to the upper face 211, and two opposite side faces 213 connecting the upper face 211 with the lower face 212. Each of the upper and the lower faces 211, 212 is formed with a pair of projections 215 thereon and a pair of stoppers 216 on rear ends thereof and adjacent to the side faces 213. The first tongue 22 is parallel to and vertically aligned with the second tongue 24. The first tongue 22 defines a plurality of signal passageways 220 and a plurality of ground passageways 221 on an upper surface thereof, a plurality of signal passageways 220, a pair of ground passageways 223, and a power passageway 222 on a lower surface thereof (shown FIG. 6). The pair of ground passageways 223 are adapted for receiving ground contacts (not shown). In this embodiment of the present invention, the pair of ground passageways 223 are unoccupied. The second tongue 24 defines a plurality of ground passageways 221 on an upper surface thereof, a plurality of signal passageways 220 on a lower surface thereof. The passageways 220, 221 and 222 extend rearwardly throughout the main body 21.

Figure 2:
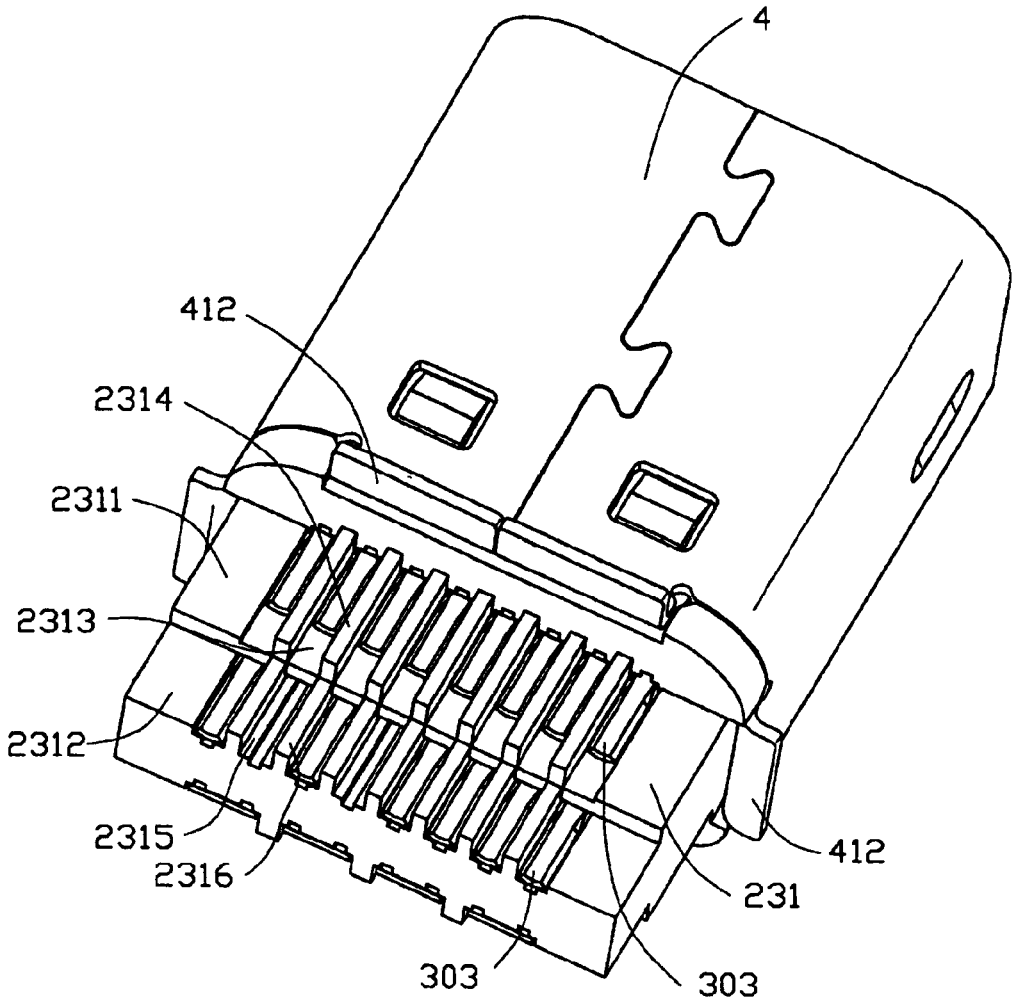
FIG. 2 is a rear, top and left perspective view of the electrical connector of FIG. 1.
Figure 5:
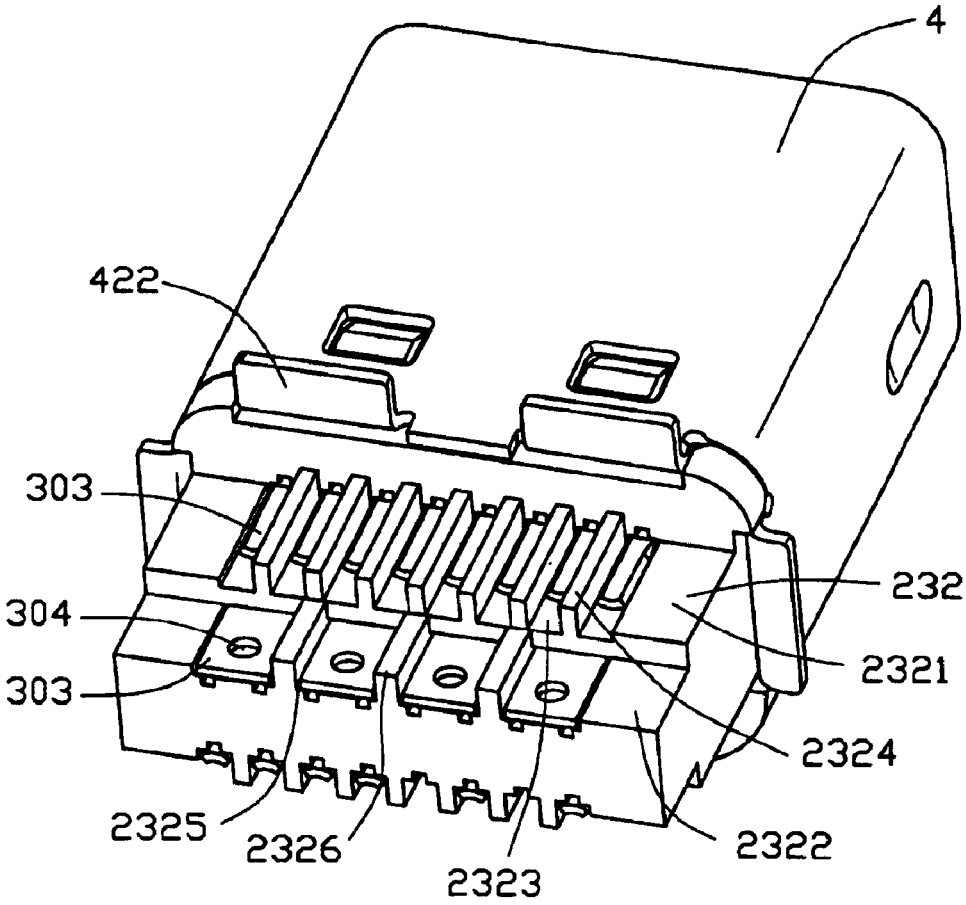
FIG. 5 is a rear, bottom and right view of the electrical connector.

Referring to FIGS. 2 and 5, the mounting portion 23 has an upper side 231 and a lower side 232 opposite to the upper side 231. The upper side 231 has a first face 2311 and a second face 2312 behind the first face 2311. The second face 2312 is parallel to and downwardly offset from the first face 2311. The upper side 231 defines a plurality of first channels 2313 on the first face 2311 and a plurality of second channels 2315 on the second face 2312, and is formed with a plurality of first ribs 2314 on the first face 2311 and a plurality of second ribs 2316 on the second face 2312. Each of the first channels 2313 communicates with a corresponding passageway on the upper surface of the first tongue 22. Every two adjacent first channels 2313 are separated from each other by a corresponding first rib 2314 therebetween. Each of the second channels 2315 is aligned with a corresponding first channel 2313 on the first face 2311 and communicates with a corresponding passageway on the lower surface of the first tongue 22. Every two adjacent second channels 2315 are separated from each other by a corresponding second rib 2316 therebetween.

The lower side 232 has a third face 2321 and a fourth face 2322 behind the third face 2321. The fourth face 2322 is parallel to and upwardly offset from the third face 2321. The lower sides 232 defines a plurality of third channels 2323 on the third face 2321 and a plurality of fourth channels 2325 on the fourth face 2322, and is formed with a plurality of third ribs 2324 on the third face 2321 and a plurality of fourth channels 2326 on the fourth face 2322. Each of the third channels 2323 communicates with a corresponding passageway on the lower surface of the second tongue 24. Every two adjacent third channels 2323 are separated from each other by a corresponding third rib 2324 therebetween. Each of the fourth channels 2325 communicates with corresponding two adjacent passageways on the upper surface of the second tongue 24. Every two adjacent fourth channels 2325 are separated from each other by a corresponding fourth rib 2326 therebetween.

Figure 4:
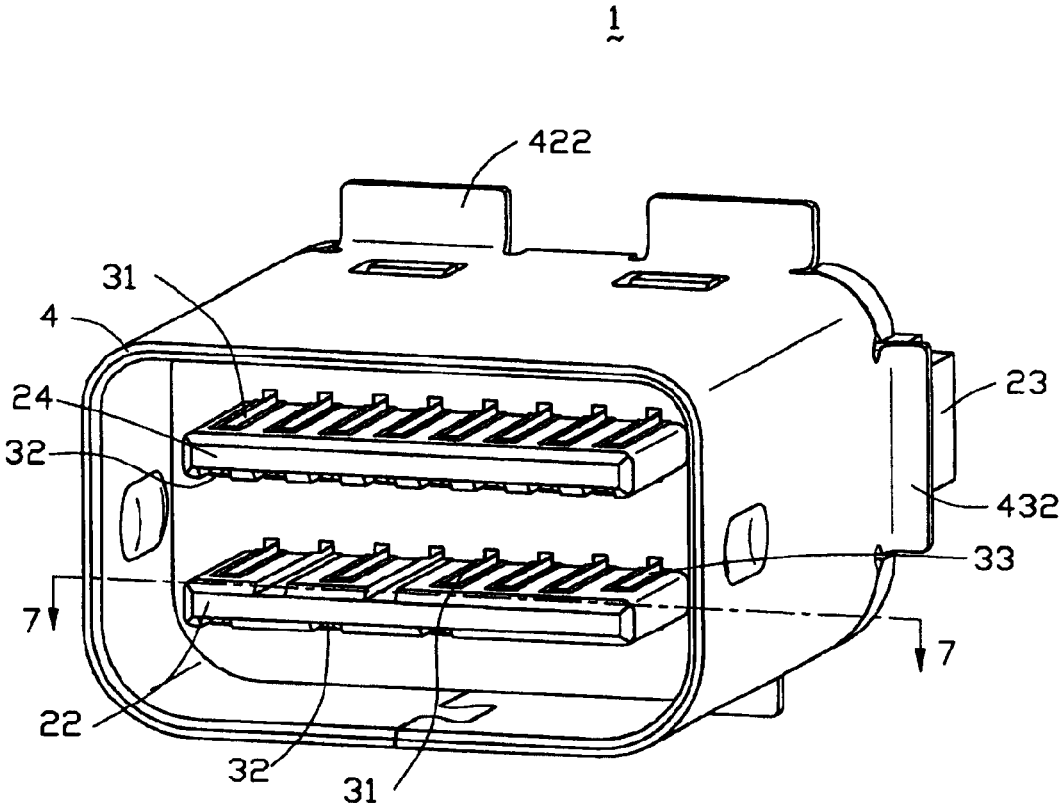
FIG. 4 is a front, bottom and left view of the electrical connector.
Figure 7:
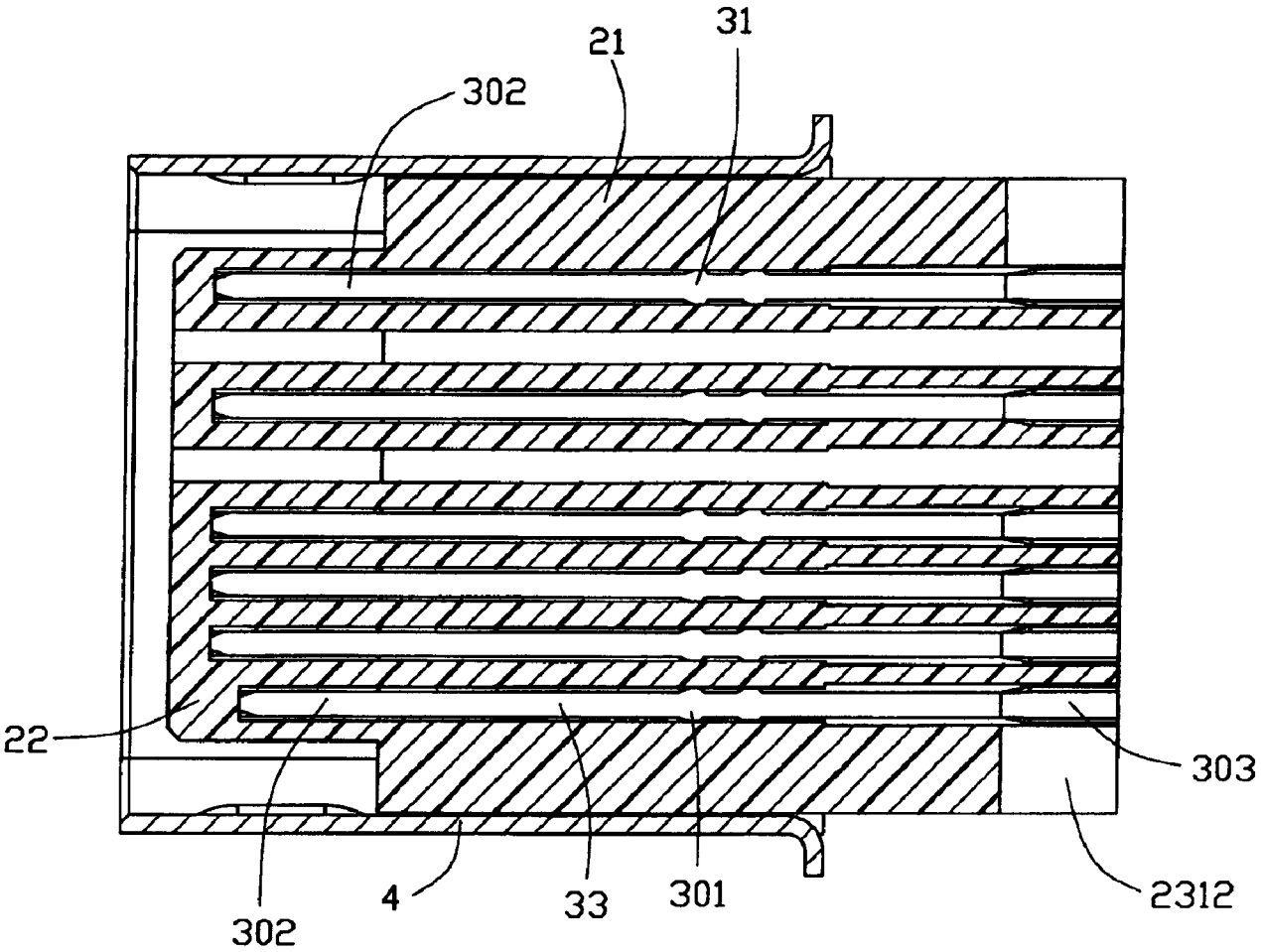
FIG. 7 is a cross-sectional view taken along line 7—7 of FIG. 4.
Figure 8:
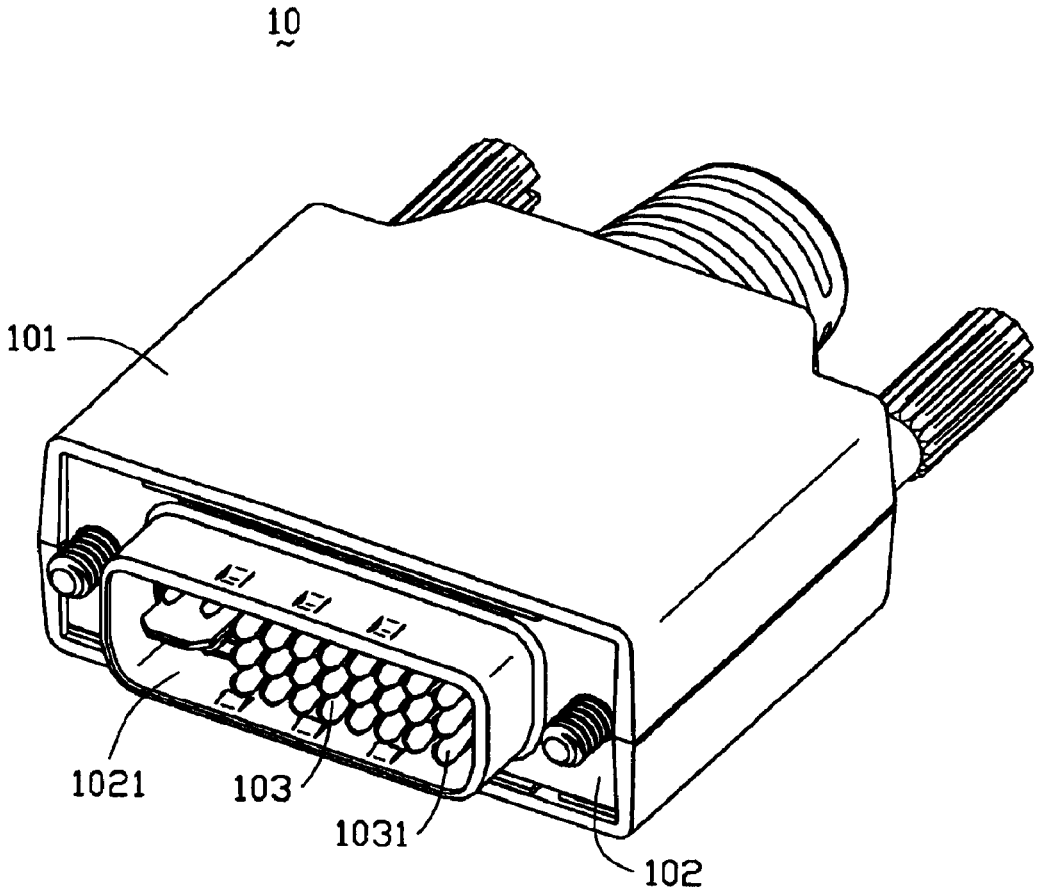
FIG. 8 (PRIOR ART)
FIG. 8 is a perspective view of a conventional electrical connector.

Referring to FIGS. 3 and 6 in conjunction with FIGS. 1, 4 and 7, the contacts 3 comprises a plurality of signal contacts 31, a plurality of ground contacts 32, and a power contact 33. The signal, ground and power contacts 31, 32, and 33 have similar configurations. Each contact 3 comprises a retention portion 301, a contact portion 302 extending forwardly from the retention portion 301, and a tail portion 303 extending rearwardly from the retention portion 301. The contacts 3 are assembled to the insulative housing 2 with the retention portions 301 interferentially fitted in the main body 21, with the contact portions 302 received in the corresponding passageways of the first and the second tongues 22, 24, and with the tail portions 303 received in the channels of the mounting portion 23 for simplifying soldering between the tail portions 303 and wires of a cable (not shown). The ribs formed between the corresponding adjacent channels can prevent short circuits between the tail portions 303 of the contacts or the wires of the cable. The contact portions 302 of the ground contacts 32 extend forwardly to front edges of the first and the second tongues 22, 24. The contact portions 302 of the signal and the power contacts 31, 33 are behind free ends of the contact portions 302 of the ground contacts 32. When the electrical connector 1 is mated with a complementary connector (not shown), the contacts portions 302 of the ground contacts 32 contact with corresponding portions of ground contacts or conductors of the complementary connector before the signal and the power contacts 31, 33 for Electro-Static discharge (ESD).

Referring to FIGS. 3 and 5, the tail portions 303 of the corresponding two adjacent ground contacts 32 received in the ground passageways 221 on the upper surface of the second tongue 24 are integrally formed. The integrally formed tail portions 303 of the two adjacent ground contacts 32 define a hole 304 therein for ensuring a good connection with a wire of a cable (not shown) during the soldering process. The integrally formed tail portions 303 are received in the fourth channels 2325 on the four face 2322 of the lower side 232.

Referring to FIGS. 1, 3 and 6 again, the shell 4 comprises an upper wall 41, a lower wall 42 opposite to the upper wall 41, and a pair of side walls 43 connecting the upper wall 41 with the lower wall 42. Each of the upper and the lower walls 41, 42 define a pair of openings 411 therein. The upper wall 41 has an upper tab 412 extending upwardly from a rear edge thereof. The lower wall 42 has a pair of lower tabs 422 extending downwardly form a rear edge thereof. The pair of side walls 43 have a pair of side tabs 432 extending outwardly from rear edges thereof. The shell 4 is retained to the insulative housing 2 and encircles the main body 21 and the tongues 22, 24. The projections 215 of the insulative housing 2 are received in the openings 411 of the shell 4. The rear edges of the shell 4 abut against the stoppers 216 of the insulative housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a main body, and a mounting portion extending rearwardly from the main body and comprising a first and a second faces on a first side thereof, the main body defining a plurality of passageways extending therethrough, the second face of the mounting portion being parallely behind and downwardly offset from the first face forming a step configuration, the mounting portion defining a plurality of first and second channels on the first and the second faces respectively and in communication with corresponding passageways; and a plurality of contacts each comprising a retention portion retained to the insulative housing, a contact portion extending forwardly from the retention portion, and a tail portion extending rearwardly from the retention portion and received in a corresponding channel;

wherein the mounting portion of insulative housing comprises a third and a fourth faces on a second side opposite to the first side, the fourth face being parallely behind and upwardly offset from the third face forming a step configuration, the mounting portion defining a plurality of third and fourth channels on the third and fourth faces respectively and in communication with corresponding passageways.

2. The electrical connector as claimed in claim 1, wherein the insulative housing comprises a first and a second tongues extending forwardly from the main body, and wherein the passageways of the insulative housing extend forwardly along upper and lower surfaces of the first and second tongues and receive the contact positions of the contacts.

3. The electrical connector as claimed in claim 2, wherein the first and the second channels of the mounting potion communicate with the passageways on the upper and the lower surfaces of the first tongue, respectively, and wherein the third and fourth channels of the mounting portion communicate with the passageways on the lower and the upper surfaces of the second tongue, respectively.

4. The electrical connector as claimed in claim 2, wherein the contacts comprise a plurality of signals contacts, a plurality of ground contacts and a power contact.

5. The electrical connector as claimed in claim 4, wherein the contact portions of the ground contacts extend forwardly to front edges of the tongue, and wherein the contact portions of the signal and the power contacts are behind free ends of the contact portions of the ground contact.

6. The electrical connector as claimed in claim 1, wherein the mounting portion of the insulative housing is formed with a rib between every two adjacent channels.

7. The electrical connector as claimed in claim 1 further comprising a shell retained to the insulative housing and encircling the main body.

8. The electrical connector as claimed in claim 7, wherein the shell comprises an upper wall, a lower wall opposite to the upper wall, and the two opposite side walls connecting the upper wall with the lower wall, each of the upper and the lower walls defining a pair of openings therein.

9. The electrical connector as claimed in claim 8, wherein the main body of the insulative housing comprises an upper face, a lower face opposite to the upper face, and two opposite side faces connecting the upper face with the lower face, each of the upper and the lower faces being formed with a pair of projections thereon and received in the corresponding openings of the shell.

10. The electrical connector as claimed in claim 9, wherein each of the upper and the lower faces of the main body is formed with a pair of stoppers on rear end thereof and adjacent to the side faces of the main body, and wherein rear edges of the shell abuts against the stoppers.

11. The electrical connector as claimed in claim 9, wherein the shell comprises an upper tab extending upwardly from a rear edge of the upper wall, a lower tab extending downwardly from a rear edge of the lower wall, and a pair of side tabs extending outwardly from the rear edges of side of the walls.

12. An electrical connector comprising:

an insulative housing comprising a main body, and a mounting portion extending rearwardly from the main body, the main body defining a plurality of passageways extending therethrough, the mounting portion defining a plurality of channels, one of the channels communicating with two corresponding adjacent passageways; and a plurality of contacts each comprising a retention portion retained to the insulative housing, a contact portion extending forwardly from the retention portion, and a tail portion extending rearwardly from the retention portion, the tail portions of two of the contacts being integrally formed and received in the one of the channels;

wherein the mounting portion of insulative housing comprises a first and a second faces on a first side, a third and a fourth faces on a second side opposite to the first side;

wherein the second face being parallely behind and downwardly offset from the first face forming a step configuration; and wherein the fourth face being parallely behind and upwardly offset from the third face forming a step configuration.

13. The electrical connector as claimed in claim 12, wherein the mounting portion of the insulative housing is formed with a rib between every two adjacent channels.

14. The electrical connector as claimed in claim 12, wherein another one of the channels communicates with one of the passageways, and wherein the tail portion of another one of the contacts is received in the another one of the channels.

15. The electrical connector as claimed in claim 12, wherein the channels comprises a plurality of the first, second, third, and fourth channels on the first, the second, the third, the fourth faces, respectively.

16. The electrical connector as claimed in claim 15, wherein the insulative housing comprises a first and a second tongues extending forwardly from the main body, and wherein the passageways of the insulative housing extend forwardly along upper and lower surfaces of the first and the second tongues and received the contacts portions of the contacts.

17. The electrical connector as claimed in claim 16, wherein the first and the second channels of the mounting portion communicate with the passageways on the upper and the lower surfaces of the first tongue, respectively, and wherein the third and fourth channels of the mounting portion communicate with the passageways on the lower and the upper surfaces of the second tongue, respectively.

* * * * *